US006530117B2

(12) United States Patent
Peterson

(10) Patent No.: US 6,530,117 B2
(45) Date of Patent: Mar. 11, 2003

(54) WET VACUUM

(76) Inventor: Robert A. Peterson, 1107 Fuller St., Apartment DD, Greensboro, NC (US) 27403

( * ) Notice: Subject to any disclaimer, the term of this patent is extended or adjusted under 35 U.S.C. 154(b) by 0 days.

(21) Appl. No.: 09/780,388

(22) Filed: Feb. 12, 2001

(65) Prior Publication Data

US 2002/0108209 A1 Aug. 15, 2002

(51) Int. Cl.[7] ..... A47L 11/30

(52) U.S. Cl. ..... 15/353; 15/340.2; 15/320; 15/323; 15/401; 15/352

(58) Field of Search ..... 15/340.2, 353, 15/401, 320, 323, 352

(56) References Cited

U.S. PATENT DOCUMENTS

| | | | | | |
|---|---|---|---|---|---|
| 1,923,689 | A | * | 8/1933 | Rosenberg | 15/320 |
| 2,635,277 | A | | 4/1953 | Belknap | 15/322 |
| 3,063,082 | A | | 11/1962 | Rosenberg | 15/353 |
| 3,496,591 | A | | 2/1970 | Sheler | 15/320 |
| 3,871,051 | A | | 3/1975 | Collier | 15/321 |
| 4,062,085 | A | * | 12/1977 | Duncan | 15/353 |
| 4,173,056 | A | | 11/1979 | Geyer | 15/320 |
| 4,200,951 | A | * | 5/1980 | Burgoon et al. | 15/353 |
| 4,619,010 | A | | 10/1986 | Burgoon | 15/320 |
| 4,809,396 | A | * | 3/1989 | Houser | 15/320 |
| 4,817,233 | A | | 4/1989 | Waldhauser | 15/320 |
| 4,961,246 | A | | 10/1990 | Hauge et al. | 15/401 |
| 5,063,633 | A | * | 11/1991 | Ingermann et al. | 15/320 |
| 5,093,955 | A | * | 3/1992 | Blehert et al. | 15/320 |
| 5,354,347 | A | * | 10/1994 | McCoy et al. | 15/353 |
| 5,369,838 | A | * | 12/1994 | Wood et al. | 15/320 |
| 5,465,456 | A | * | 11/1995 | Fellhauer et al. | 15/320 |
| 5,566,422 | A | * | 10/1996 | Geyer | 15/320 |
| 5,819,365 | A | | 10/1998 | Huffman et al. | 15/321 |
| 5,829,095 | A | * | 11/1998 | Legatt et al. | 15/353 |
| 5,846,334 | A | * | 12/1998 | Hoce | 15/353 |
| 5,911,260 | A | | 6/1999 | Suzuki | 15/401 |
| 6,061,868 | A | * | 5/2000 | Moritsch et al. | 15/320 |
| 6,131,240 | A | * | 10/2000 | Shark et al. | 15/320 |

FOREIGN PATENT DOCUMENTS

| | | |
|---|---|---|
| GB | 855613 | 12/1960 |
| SU | 248921 | 12/1969 |

* cited by examiner

*Primary Examiner*—Theresa T. Snider
(74) *Attorney, Agent, or Firm*—Richard C. Litman

(57) ABSTRACT

An improved wet vacuum is described which removes floor stripping chemicals and residual water left behind from a floor stripping machine. The vacuum system is portable, battery operated and houses a storage reservoir constrained via elastic straps on a rollable base. A vacuum box is operatively mounted to a motor and include moisture reduction features which reduce moisture accumulation in and around the motor via an adapted flow path and drain channel. A single lever and rear activated squeegee mechanism which is in fluid communication with the vacuum system is selectively lowered an raised for removing floor cleaning chemicals and/or other liquids from the surface of a floor. An interior mechanical brace assembly is also featured to prevent reservoir buckling from operative vacuum pressure. A simple control module is provided for operating and monitoring power for the system.

15 Claims, 9 Drawing Sheets

WET VACUUM

BACKGROUND OF THE INVENTION

1. Field of the Invention

The present invention generally relates to floor maintenance machines. More specifically, the invention is a wet vacuum for removing stripping chemicals and/or compounds from floors.

2. Description of the Related Art

A variety of floor maintenance machines have been devised for restoring or cleaning and drying floors. In earlier designs, between the era of 1953 and 1967, in particular, cleaning and drying features of conventional floor maintenance devices were provided as separate or decoupled operative features. This was primarily due to the detrimental effects of moisture on the electrical components and the lack of available technology at the time to render the conventional devices operative as electrically coupled systems. The need for available on-board power as an independent power source also contributed as a secondary issue to the apparent lack of a technical remedy during this era. The following references describe floor maintenance devices which attempted to remedy this problem.

U.S. Pat. No. 2,635,277 issued to Belknap discloses a suction-operated device for scrubbing and drying floors. The structure of the device is particularly directed to a housing which is adapted to contain a specified amount of a selected liquid cleaner. The liquid cleaner is introduced into the housing through a filler opening formed in a top wall and adapted to be closed by a cap mounted on the top wall.

The rear section of the '277 device has a bottom wall which is inclined upwardly with respect to the front section at an angle of 10 degrees and a scrubbing brush is secured against the bottom wall section adjacent the rear edge via mechanical screw fasteners anchored in flanges. The bristles of the brush project below the bottom edges of the flanges and are engaged with the floor surface to be cleaned by tilting the front side portion of the housing. The vacuum cleaning mechanism is inoperative during scrubbing to prevent moisture or liquid from entering the vacuum. Similar devices are described in U.S. Patents issued to Rosenberg (U.S. Pat. No. 3,063,082) and Sheler (U.S. Pat. No. 3,496,591) which operate based on the supply of alternating current (AC). Later models replaced fixed bristles with rotating cleaning brushes.

U.S. Patents issued to Collier (U.S. Pat. No. 3,871,051) and Waldhauser (U.S. Pat. No. 4,817,233) disclose cleaning machines which utilize a rotating cleaning brush. Of particular note, the patent issued to Collier discloses a brush which is housed within a casing having rear wheels and which is rotatably activated or driven via a set of drive belts which link the brush to a motor. At the front end of the housing adjacent the brush, a channel shaped nozzle shoe is mounted to the casing and is held in place by bolts and is sealed by a silicone sealant to prevent leakage therearound. A hose which is centrally located with respect to the casing and adapted to a channel formed therein is in communication with the nozzle through which spent cleaning fluid and dirt is vacuumed into a recovery tank not shown in the drawings.

U.S. Pat. No. 4,173,056 issued to Geyer discloses a scrubbing machine with a tracking squeegee. The machine has a body portion which is supported on a pair of drive wheels and a pair of pivotable casters. The squeegee is drawn by a principal arm and the location of the squeegee is controlled by a steering arm. The squeegee is pivotally connected to each arm, the arms being mounted to the underside of the body portion at two distinct pivoting locations.

U.S. Pat. No. 4,619,010 issued to Burgoon discloses a floor scrubber comprising a mechanism for automatically raising and lowering a squeegee assembly. The scrubber includes front wheels which are driven by a motor connected to the wheels via belts and pulleys when a moveable handle is manipulated. When the lever is directed forward the wheels are activated for forward motion and vice versa. The motor is connected to the wheels by friction discs when the handle is pulled to move the scrubber rearwardly. When the handle is pushed, the mechanism including a switch is operated to lower the squeegee assembly, and when the handle is pulled the mechanism and switch operates to raise the squeegee assembly. The lever for operating the squeegee is a spring-loaded mechanism.

Other U.S. and Foreign Patents respectively issued and granted to Hauge et al. (U.S. Pat. No. 4,961,246), Huffman et al. (U.S. Pat. No. 5,819,365), Suzuki (U.S. Pat. No. 5,911,260), Hoover (GB 855,613) and Pletenski (SU 248921) disclose conventional vacuum cleaning devices comprising squeegee features or water extraction devices of general relevance to the wet vacuum as herein described.

None of the above inventions and patents, taken either singularly or in combination, is seen to describe the instant invention as claimed. Thus a wet vacuum solving the aforementioned problems is desired.

SUMMARY OF THE INVENTION

The wet vacuum according to the invention is designed to remove floor stripping chemicals and residual water left behind from a floor stripping machine. The vacuum system is portable, battery operated and houses a storage reservoir constrained via a set of straps on a rollable base. A vacuum box is operatively mounted to a motor and includes moisture reduction features which reduce moisture accumulation in and around the motor via an adapted flow path and drain channel. A single lever and rear activated squeegee mechanism which is in fluid communication with the vacuum system is selectively lowered and raised for removing floor cleaning chemicals and/or other liquids from the surface of a floor. An interior mechanical brace assembly is also featured to prevent reservoir buckling from vacuum pressure. A simple control panel is mounted to the front face of the wet vacuum housing to monitor battery power and switch the system on or off, and has a conduit for recharging an internally housed direct current power source.

Accordingly, it is a principal object of the invention to provide an improved wet vacuum for removing stripping chemicals and/or liquids from floors.

It is another object of the invention to provide an improved wet vacuum which alleviates moisture accumulation from the vacuum box to the motor or electrical components for extended life and use.

It is a further object of the invention to provide an improved wet vacuum which utilizes an interior reinforced reservoir mechanism which prevents buckling from vacuum pressure.

Still another object of the invention is to provide an improved wet vacuum which utilizes a combination sweep arm and tilt mechanism for selectively manipulating a squeegee without the need for spring loaded mechanisms.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
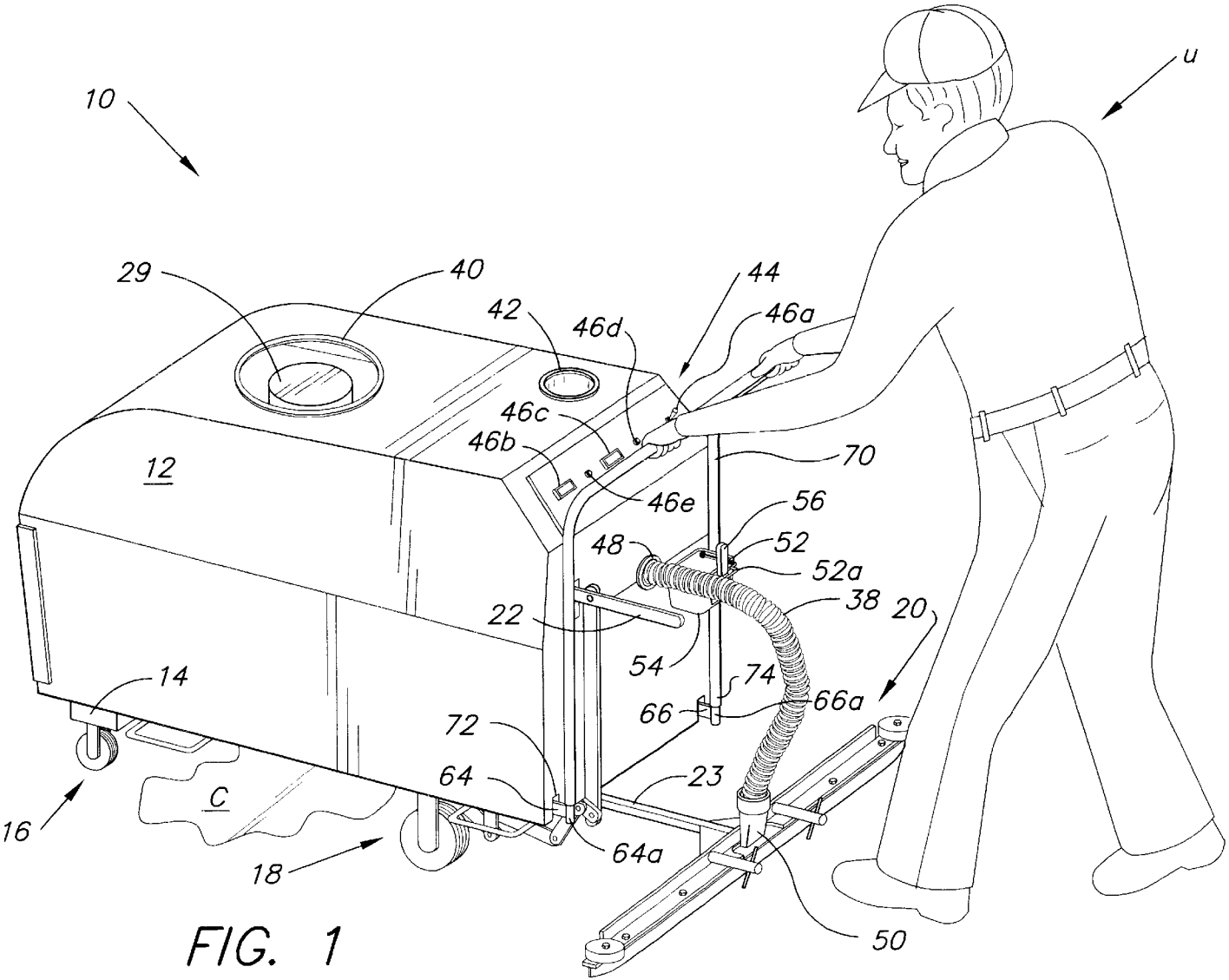
FIG. 1 is an environmental, perspective view of a wet vacuum according to the present invention.
Figure 2:
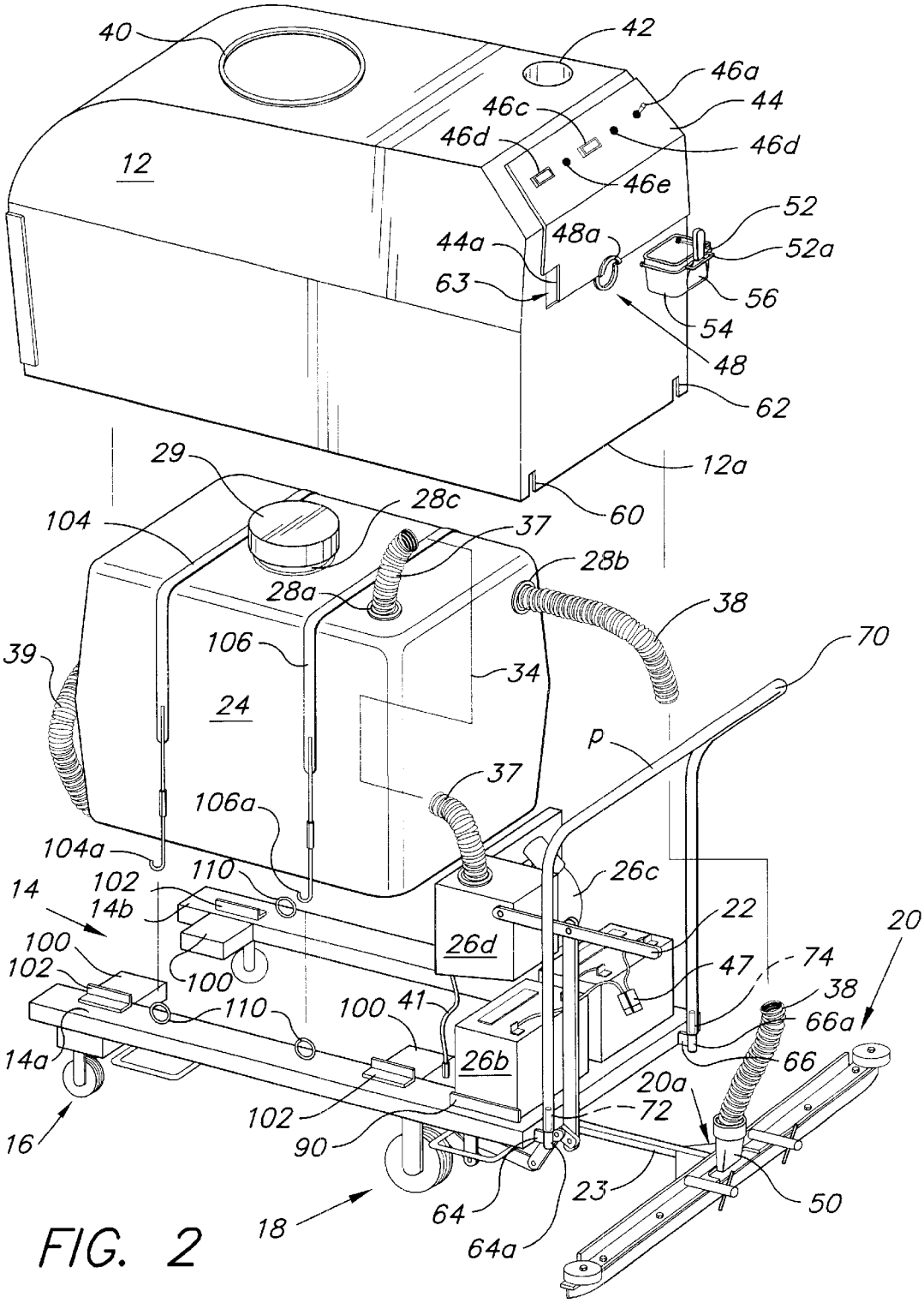
FIG. 2 is an exploded perspective view of the wet vacuum according to the invention, illustrating internal reservoir and vacuum pump features.
Figure 3:
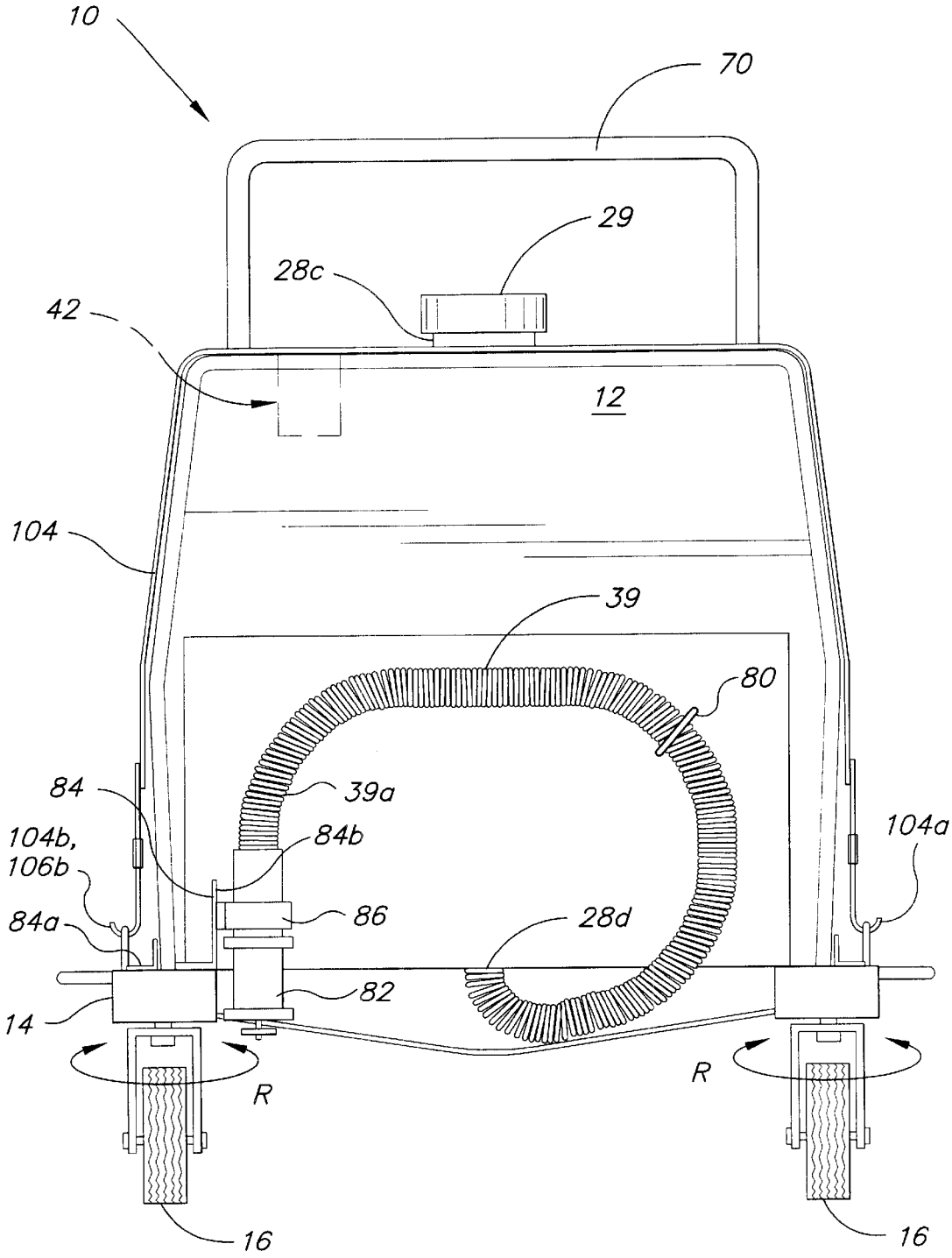
FIG. 3 is a front view of the wet vacuum according to the invention, illustrating a drain hose storage and lock configuration.

The present invention is directed to an improved wet vacuum system for removing stripping chemicals C from wet floors. The preferred embodiment of the invention is depicted in FIGS. 1–3, and is generally referenced by numeral 10. Other elemental features of the preferred embodiment 10 are further depicted in FIGS. 4–9.

As best seen in FIG. 1, the wet vacuum system 10 has a housing 12 mounted on a base support structure 14 having a respective front set of caster wheels 16, and a rear set of fixed wheels 18 for portability of the unit 10. The wheels 16 and 18 are caster-type wheels for rotation in any desired direction as indicated by the arrow R in FIG. 3 when the system 10 is wheeled about by a technician or user U.

As further shown in FIG. 1, the improved wet vacuum system 10, includes a vacuum head assembly 20, a lever mechanism 22 having a sweep arm 23 for manipulating the vacuum head assembly 20, and a reservoir 24 (within housing 12 and shown in FIG. 2) for storing or retaining spanned stripping chemicals or compounds vacuumed from a work surface.

Figure 5:
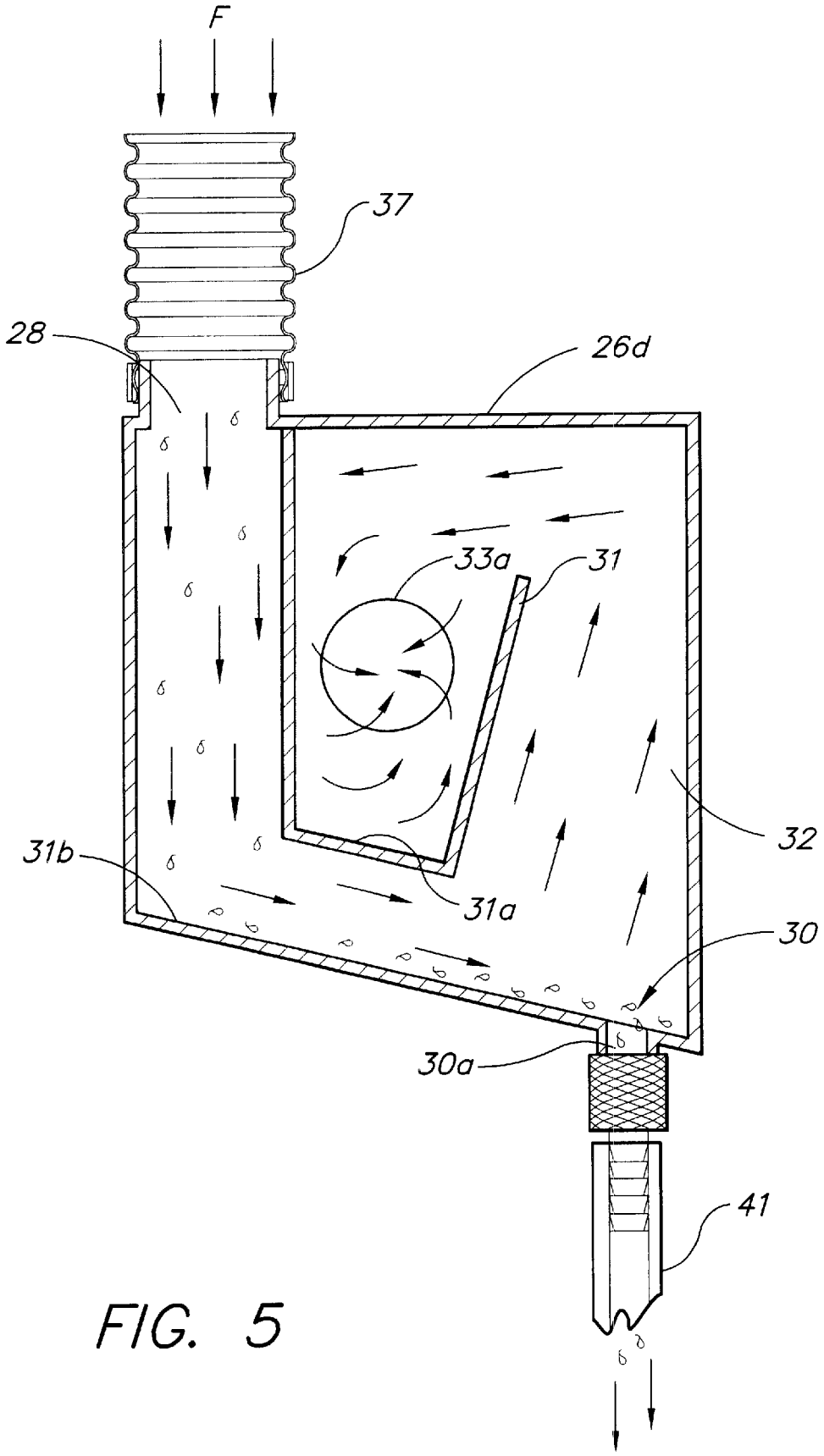
FIG. 5 is a cross-sectional view of the vacuum box of the wet vacuum according to the invention, illustrating moisture and fluid reduction in the vacuum flow path.

As diagrammatically illustrated in FIG. 2, an exploded view of the wet vacuum 10 is shown illustrating internal operative features, such as a the vacuum generating elements. The vacuum generating elements comprise a control circuit module 26*a* (shown schematically in FIG. 9), power source 26*b*, motor 26*c* and a vacuum box 26*d* having a substantially inverted J-shaped baffle 31 disposed therein. As shown in FIG. 5, the vacuum box 26*d* has at least one internal flow channel 28 which conveys and separates a vacuum pressurized fluid into air and liquid components so that the liquid component flows in a liquid path 30 through a drain 30*a* defined in the bottom wall of the vacuum box 26*d*. Accordingly, the path 30 of the liquid component after separation from the mixture is substantially opposite to a flow path of air indicated by the arrows 32 to prevent liquid migration from the reservoir 24 to an electrical component of the system 10. Notwithstanding, the flow path from the reservoir 24 to the vacuum box 26*d*, designated by line 34 in FIG. 2, illustrates a fluid connection between the flow channel orifice 28*a* and an orifice 37 disposed within a top surface portion of the reservoir 24. This fluid connection identified by line 34 is a primary vacuum flow channel which regulates the effective flow rate for the entire system 10. Within the orifice 28*a* is also a screen-covered check-ball-valve (not shown) which is mounted with the screen facing in a direction towards the bottom of the reservoir 24 and mounted to form an interface with the tubing 37 via orifice 28*a*. The check ball valve mechanism is a conventional feature which serves as a primary measure to prevent accumulated chemicals or liquid contained in the reservoir 24 from flowing into the internal flow channel 28 thereby causing a potential for short circuiting the vacuum system 10.

The reservoir 24 is a substantially rectangular reservoir 24 having respective first, second, third and fourth fluid flow orifice 28*a*, 28*b*, 28*c* and 28*d*. The first fluid orifice 28*a* is in fluid connection with at least one fluid flow channel 28 via a flow tubing or hose 37. This channel is a primary fluid flow channel of vacuum pressurized fluid. The second fluid flow orifice 28*b* is in fluid connection with the vacuum head assembly 20 via a flow tube 38.

Figure 8:
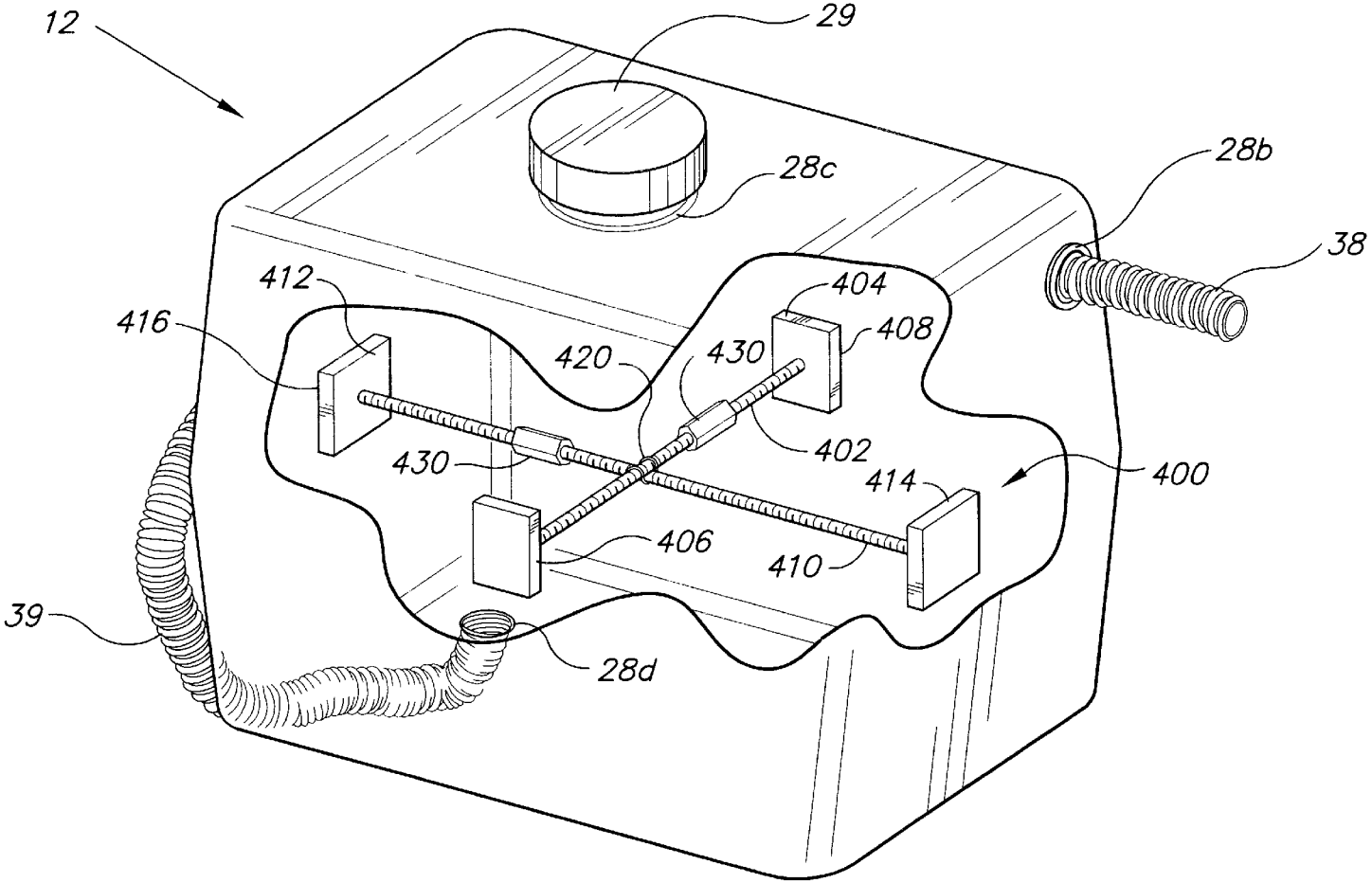
FIG. 8 is cut-away perspective view of the reservoir, illustrating the reinforced interior reservoir mechanism according to the invention.

The third fluid flow orifice 28*c* is a combination fluid supply and passage orifice for installing and adjusting a reservoir reinforcement mechanism, diagrammatically illustrated in FIG. 8. The orifice 28*c* is disposed in a top portion of the reservoir 24, and is a threaded orifice which includes a mating cap 29 having internal threads for attaching to and sealing the third orifice 28*c*. The cap 29 protrudes from the housing 12 via a first circular aperture 40 disposed in a central portion of the top wall of the housing 12 for insertably receiving the cap 29 secured to the threaded orifice 28*c*. This is better shown in FIG. 3. The housing 12 further includes at least one recessed aperture 42 in the top wall of the housing as a storage aperture for beverages, mechanical fasteners, etc. Disposed adjacent to the storage aperture 42 in the housing 12 is a control panel 44 for mounting a control module 46 which provides a on/off switch 46*a*, battery power meter 46*b*, a battery recharging adapter module 46*c*, an indicator light 46*d* and at least one fuse housing or circuit breaker 46*e* (schematically illustrated in FIG. 9).

Disposed in the rear wall of the housing is a substantially circular aperture 48 having a arcuate lip portion 48*a* for insertably receiving and retaining a vacuum head hose 38 adapted for connection with the vacuum head assembly 20 via a suction port 50. The suction port 50 is fixedly mounted to a central portion 20*a* of the vacuum assembly 20. The housing 12 further comprises a bracket 52 and bucket 54 assembly mounted adjacent to the aperture 48 for storing removed floor deposits therein. The bracket 52 is secured to a wall portion of the housing 12 via mechanical fasteners, and includes a second aperture 52*a* for insertably storing a scraping tool 56 for removing deposits from the surface of a work floor or space.

A first and second rectangular recess 60 and 62 are disposed at a lower edge portion 12*a* of the rear wall of the housing. Each recess 60 and 62 insertably rests on the base support structure 14 at respective first and second protruding or cantilevered mount support structures 64 and 66 which are welded to the base structure 14. Each cantilevered support structure 64 and 66 terminates with respective solid cylindrical studs 64*a* and 66*a* of predetermined dimensions for insertable attachment with a substantially U-shaped cylindrical handle 70 via first and second hollow ends 72 and 74 which slide onto studs 64*a* and 66*a* as a male and female mechanical attachment.

Figure 6:
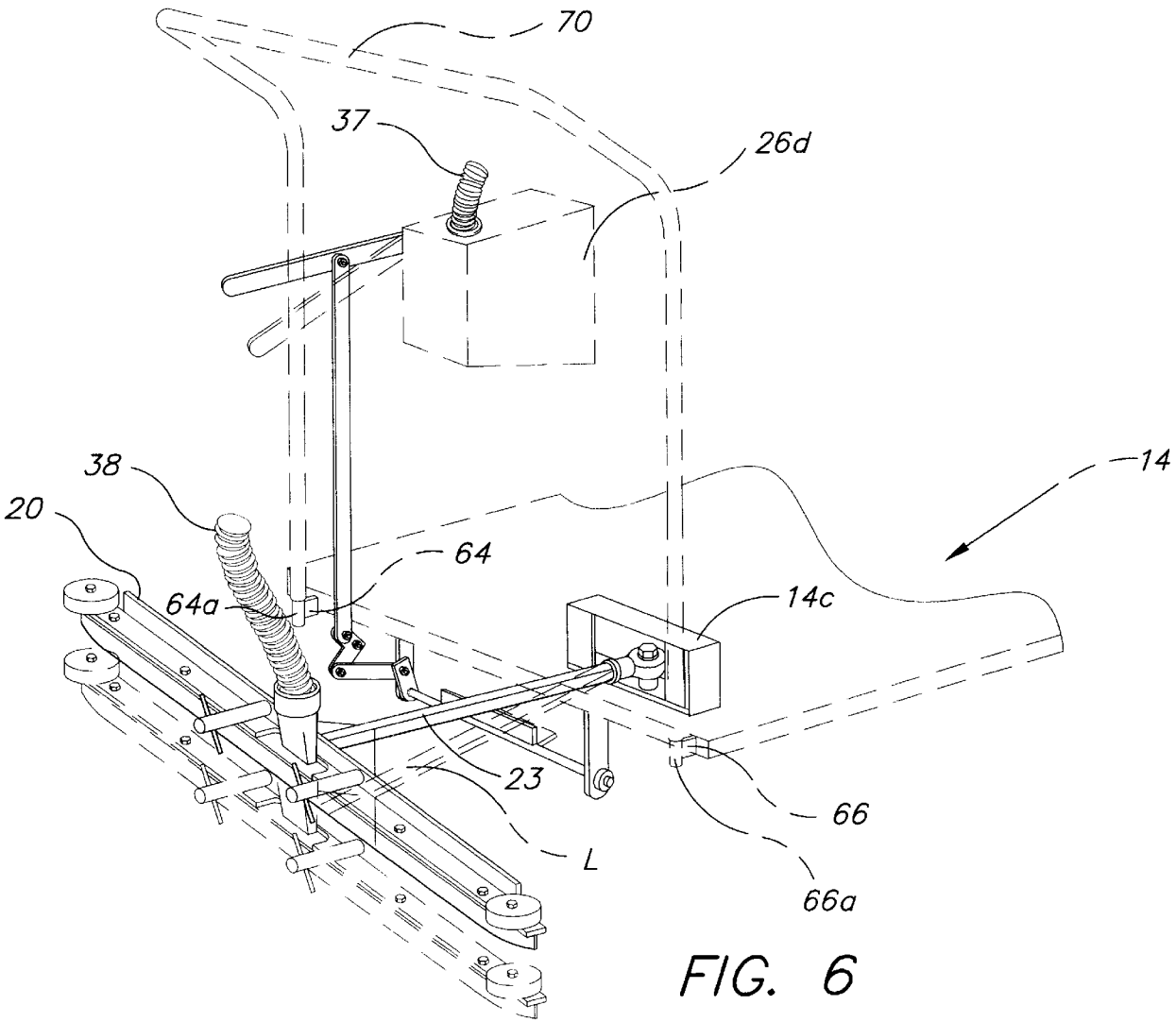
FIG. 6 is a perspective view of the combination sweep arm and tilt mechanism for selectively manipulating a squeegee according to the invention.

A third rectangular recess 63 is formed contiguous with an edge portion 44*a* of the control panel 44 for insertably receiving and retaining a lever mechanism 22 therethrough for operatively manipulating the vacuum head assembly 20 via a sweep arm 23 as more clearly illustrated in FIG. 6, and further described below. It is noted that the fourth fluid orifice 28*d* is fluidly connected to a drain hose 39 for draining the stripping chemicals collected from the reservoir 24. This particular feature is more clearly shown in FIG. 8.

The base 14 of the wet vacuum system 10 is a substantially U-shaped rollable base 14 having at least one means or guide plate 90 mounted at the base of the U-shaped base 14 for mounting at least one direct current power source or battery 26*b*. The guide plate(s) 90 will serve to secure the power source 26*b* thereon without battery translation when the system 10 is in use. It is noted that the handle 70 is removable from the studs 64*a* and 66*a* via an upward or vertical force applied at a central point P along the handle 70 for complete removal therefrom. As shown in FIG. 2, the handle 70 is a substantially U-shaped cylindrical handle. Ends 72 and 74 respectively slide onto respective studs 64*a* and 66*a* to form a friction fit as a male and female attachment. Adjacent thereto and extending substantially the same width as the U-shaped handle is the power supply 26*b* comprising batteries (such as lead acid or gel cell batteries) of predetermined voltage for running the circuit control module 46 and vacuum motor 26*c* according to the invention. A modular power line connector 47 connects to the control module 46 to provide operative power for the wet vacuum system 10.

To accommodate the reservoir 24, the base 14 provides a respective first and second support surface 14*a* and 14*b* for supporting and retaining the reservoir 24 thereon. The addition of support studs or blocks 100, mounted to an interior portion of the respective first and second portions 14*a* and 14*b* of the base 14 near the front wheels 16 and near the rear wheels 18, provide support reinforcement for the reservoir 24. A series of reservoir right angle guide plates 102 are respectively mounted at spaced intervals along surface portions 14*a* and 14*b* to retain the reservoir therein without undue translation or movement. Each support stud 100 is preferably welded to the base 14 to for a single steel structural frame. Other materials such as composite metals and plastic or matrix of such materials thereof can be used depending on the loading capacity and degree of durability desired. Thus, material and dimensional features are not described, since such is considered to be well within the skill of one having ordinary skill in the relevant art.

Additional measures for securing the reservoir to the base are made by the use of a first and second strap 104 and 106. Each strap 104 and 106 has a predetermined elasticity or stretch length for adjustability. Each end of the straps 104 and 106 include a respective first and second hooks 104*a*, 104*b* and 106*a*, 106*b*, respectively for attachment to the base 14. Each respective hook 104*a*,104*b* and 106*a*,106*b* (symmetric with 104*b* in FIG. 3) of the respective straps 104 and 106 are attached to at least one circular ring 110 mounted on both surfaces 14*a* and 14*b* at equally spaced intervals and in sequence for retaining the reservoir 12 thereon.

As diagrammatically, illustrated in FIG. 3, the wet vacuum system 10 is shown according to a front perspective view, illustrating a retaining means or hook 80 for retaining the drain channel or hose 39 in a stored configuration. At the end 39*a* of the hose 39 there is disposed control valve 82 which prevents free flow of fluid from the reservoir 12. A substantially L-shaped hose mount 84 is welded to the base 14 at end 84*a*. The free end 84*b* has a bifurcated spring clamp 86 for releasably and frictionally securing the control valve end of the hose 39 thereto. Arrows R also identify rotation directions of the front wheels 16.

Figure 4:
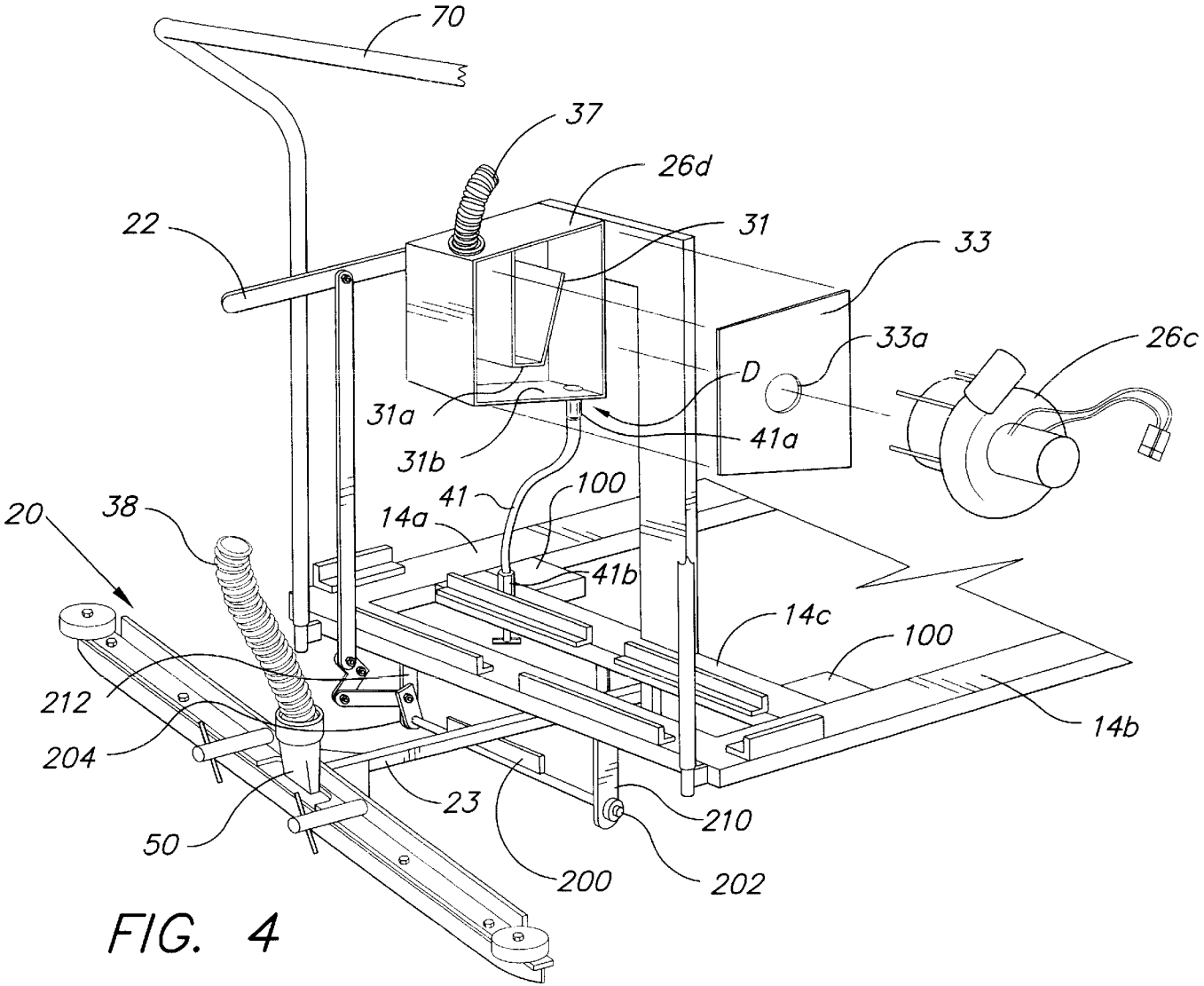
FIG. 4 is an exploded perspective view of the vacuum box assembly of the wet vacuum according to the invention, illustrating a squeegee and partial structural supports.

As diagrammatically illustrated in FIG. 4, exploded features of the vacuum box 26*d* are illustrated to reveal the internal baffle 31 which partially governs the fluid separation process of air and liquid therein through the flow path channel 28. The baffle 31 as shown therein is substantially V-shaped, except that the base 31*a* of the baffle 31 is substantially planar having a predetermined slope for preventing the flow of liquid to the motor 26*c* or any electrical component connected therewith. The vacuum motor 26*c* is mounted to the vacuum box 26*d* through a single central aperture 33*a* defined in plate 33. The base 31*b* of the vacuum box 26*d* has a predetermined downward slope to induce by the force of gravity liquid separation from a mixture of air and liquid and subsequent drainage via a liquid flow channel 41. The liquid flow channel or hose 41 is shown attached to the sloping base portion 31*b* at a point of maximum descent D via a mechanical threaded fastener or adapter means 41*a* at the base 31*b* and is fastened to a crossbar 14*c* mounted or welded between surface portions 14*a* and 14*b* and adjacent to at least one of the support studs 100 via fasteners or adapter means 41*b*. Liquid drains freely to the work space or floor from the hose 41. The mechanical attachment is made to prevent leaking via conventional sealing techniques such as the use of teflon tape, etc.

The lever mechanism 22 is also shown therein and is preferably a six-bar-linkage mechanism which activates a rotatable support plate 200 for selectively lifting and lowering the sweep arm 23 which is pivotally attached to an under portion of the crossbar 14*c*. The support plate is pivotally secured at first and second ends 202 and 204 via respective first and second mounting plates 210 and 212 fixedly attached to an under portion of the base 14 via welds. The operative feature of the sweep arm 23 enables the vacuum head 20 to traverse a substantially arcuate path of motion (i.e. from left to right). This sweeping motion and the attachment of the sweep arm 23 is more clearly illustrated in FIG. 6. As shown therein the sweep arm 23 is elevated when the lever mechanism 22 lifted vertically thereby causing a lifting force by the plate 200 to be transmitted to the sweep arm 23 for selectively raising the vacuum head 20 attached thereto and vice versa as indicated by the by the phantom lines L.

As diagrammatically illustrated in FIG. 5, a cross-section of the vacuum box 26*d* is shown for more clearly illustrating the fluid mixture separation process. As shown therein an influx of fluid mixture F enters the vacuum box 26*d* via at least one internal flow channel 28. As the mixture flows through the box 26*d*, the liquid separates from the air by gravity and flows in a liquid path 30 which terminates via a flow channel 31 in the downward sloping bottom wall 31*b* of the vacuum box 26*d*. The vacuum supplied by the motor 26*c* causes the air to be drawn upward around baffle 31*a* and through aperture 33*a*, exiting through the vacuum motor 26*c* exhaust (not shown). Accordingly, the path 30 taken by liquid after separation from the mixture is substantially opposite to a flow path of air indicated by the arrows 32 to prevent liquid migration from the reservoir 24 to an electrical component of the vacuum motor 26*c*. The liquid is subsequently drained away from the vacuum box 26*d* via hose 41 which is mechanically and fluidly sealed thereto.

Figure 7:
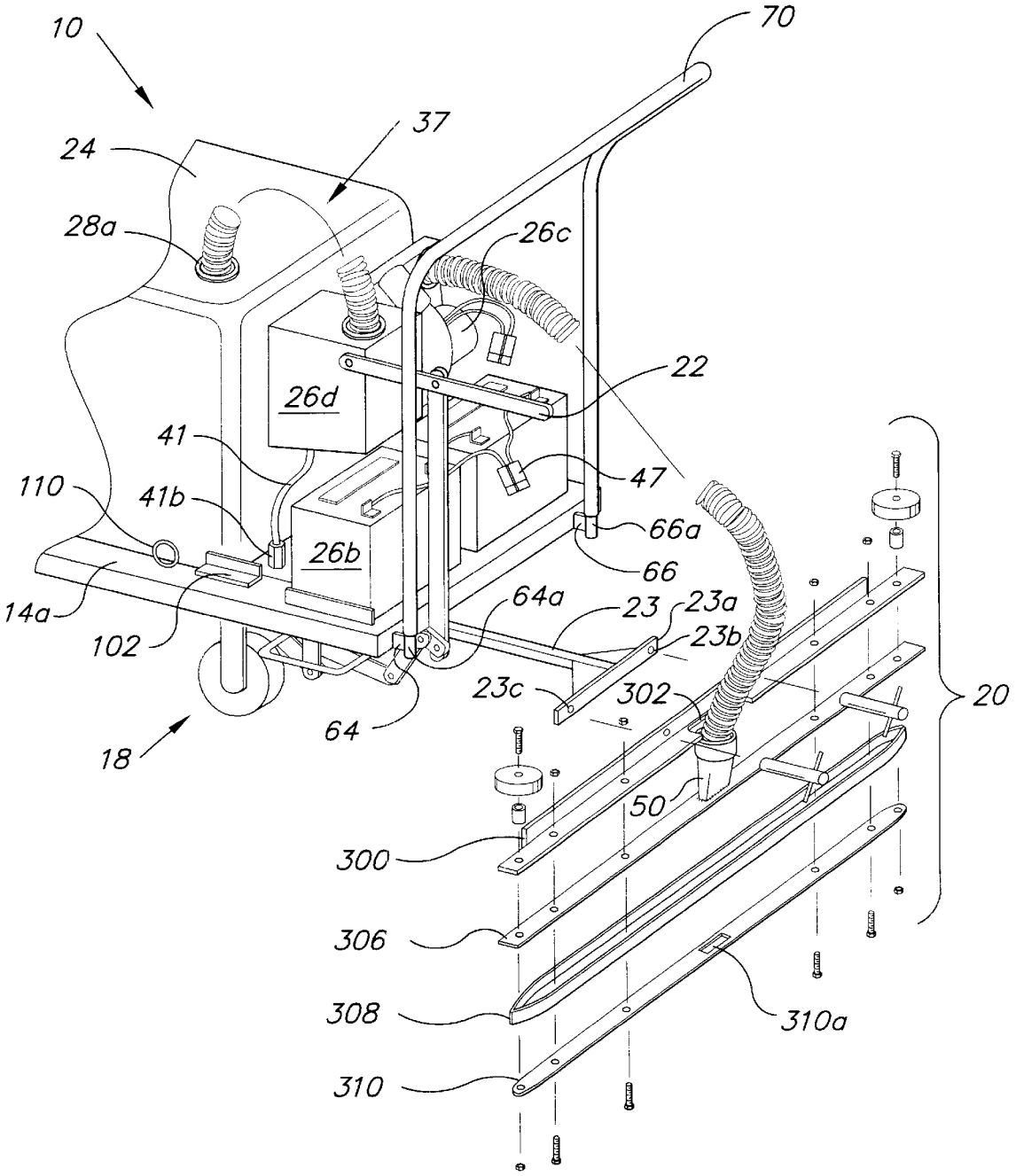
FIG. 7 is an exploded perspective view of the squeegee hose adapter according to the invention.

As diagrammatically illustrated in FIG. 7, the arm 23 is shown having vacuum head attachment plate 23*a* perpendicular thereto with first and second apertures 23*b* and 23*c* disposed therein for mechanical attachment with a support plate 300. The support plate 300 includes a semi-circular aperture 302 centrally disposed therein for insertably mounting the hose 38 therein. The suction port 50 is mounted on guide baffle 306, which makes a fluid tight seal with a diamond shaped squeegee 308 of predetermined length. The squeegee 308 is enclosed by squeegee support plate 310 having a substantially rectangular aperture 310*a* centrally disposed therein. Each vacuum head element 300, 306, 308, and 310 is mechanically secured to form a vacuum tight vacuum head assembly 20 around the suction port 50.

As diagrammatically illustrated in FIG. 8, the reservoir 24 is shown to further comprise an interior reinforced reservoir mechanism 400 which prevents reservoir 24 from buckling due to vacuum pressure. The mechanism 400 comprises a first threadedly adjustable rod 402 with first and second planar ends 404 and 406 for mating and frictionally attaching to a first 408 and second interior wall portion (not shown because of the cut-away view) of the reservoir 24. A second threadedly adjustable rod 410 with first and second planar ends 412 and 414 is also shown for mating and frictionally attaching to a third 416 and fourth interior wall portion (not shown for similar reasons recited above) of the reservoir 24. The first and second rods 402, 410 are coupled via a bracket 420 as a single integrated reinforced mechanism 400. The mechanism 400 is adjustable in length via extension and/or contraction via a turnbuckle 430 having internal threads for adjusting each respective rod 402 and 410. The significant feature of this mechanism is that it prevents implosion or collapse of the reservoir from the vacuum produced cyclic stresses.

Figure 9:
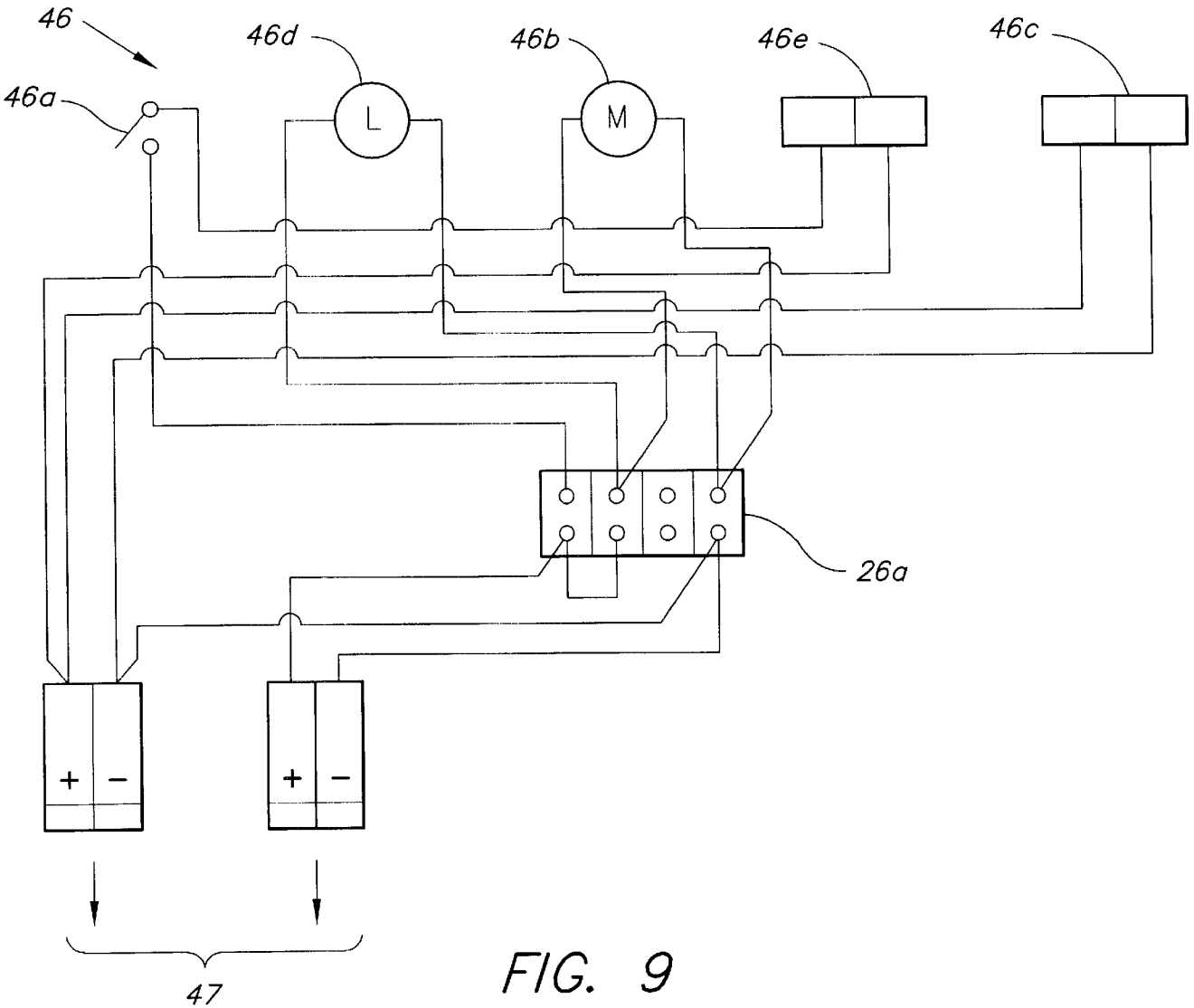
FIG. 9 is a control circuit diagram for the wet vacuum according to the invention.

FIG. 9 is a wire diagram of the control module or circuit 46 for controlling on/off switch features via element 46*a*, monitoring battery power via an analog or digital element 46*b* and for externally supplying a battery recharging unit to the system 10 via battery charging unit 46*c* for extended use or reuse. Other features such a fuse housing 46*e* or light monitor 46*d* can be used to visually indicate power activation and/or power failure. When completely assembled, the housing 12, reservoir 24, vacuum system, manipulating means 22 and vacuum head assembly 20 forms a single integrated wet vacuum system which is simple to use and manipulate. Other unique features include constructing the housing 12 of a metallic material having a polyurethane or similar outer coating to prevent rust and corrosion.

It is to be understood that the present invention is not limited to the embodiments described above, but encompasses any and all embodiments within the scope of the following claims.

I claim:

1. A wet vacuum system for removing liquids from floors comprising:

a substantially U-shaped support base structure having a plurality of wheels for rolling contact with a floor and at least one support plate for mounting at least one direct current power source thereon;

a housing mounted on said base structure;

a substantially U-shaped cylindrical handle disposed rearward of said housing and detachably mounted to said base;

a vacuum head assembly disposed rearward of said housing and connected to said base structure by sweep arm;

a lever mechanism mounted rearward of said housing and interconnected to said vacuum head assembly for raising and lowering said vacuum head assembly;

a reservoir mounted on said base structure within said housing for receiving liquids removed from a wet floor surface, said reservoir having a drain for draining the liquids from said reservoir;

a plurality of rings mounted to said base at equally spaced intervals, each of the rings receiving a hook connected to at least one strap for securing said reservoir to said base; and vacuum means for producing a vacuum by drawing air from said reservoir, said vacuum means being mounted within said housing and including a vacuum box in fluid connection with said reservoir, said vacuum box defining an internal baffle for separating liquids from the air drawn from said reservoir and subsequent drainage of the fluids from said vacuum box.

2. The wet vacuum system according to claim 1, wherein said vacuum means comprises at least a control circuit module, a power source electrically connected to said control circuit module, and a vacuum motor electrically connected to said control circuit module, said vacuum motor being attached to said vacuum box.

3. The wet vacuum system according to claim 1, wherein said at least one strap is an elastic strap for releasably securing said reservoir to said base.

4. The wet vacuum system according to claim 1, wherein said at least one strap is a metallic strap for securing said reservoir to said base.

5. The wet vacuum system according to claim 1, wherein said reservoir has a first, second, third and fourth fluid flow orifice, said first fluid orifice being connected to said vacuum box, said second fluid flow orifice being connected to said vacuum head assembly, said third fluid flow orifice being disposed in a top portion of the reservoir and being a threaded orifice with a mating cap for fluidly sealing the third orifice, and said fourth fluid flow orifice defining the drain in said reservoir.

6. The wet vacuum system according to claim 5, wherein said housing further comprises:

a first circular aperture defined therein for insertably receiving the cap of the third orifice; and at least one recessed storage aperture.

7. The wet vacuum system according to claim 1, wherein said lever mechanism comprises a six-bar-linkage mechanism including a hand manipulable lever having one end mounted on said vacuum box.

8. The wet vacuum system according to claim 1, wherein said housing further comprises a control panel having a control module therein for controlling operation of said vacuum means.

9. The wet vacuum system according to claim 1, further comprising a vacuum head hose for connecting said reservoir with said vacuum head assembly.

10. The wet vacuum system according to claim 1, further comprising a bracket and bucket assembly mounted on said housing.

11. The wet vacuum system according to claim 1, further comprising retaining means for retaining a drain hose connected to said drain.

12. The wet vacuum system according to claim 1, wherein said housing is metallic and includes an outer coating to prevent rust and corrosion.

13. The wet vacuum system according to claim 1, wherein said internal baffle has a substantially inverted J-shaped structure, said structure being centrally disposed therein and has at least one edge fixedly and continuously attached to an interior wall portion of the vacuum box; the baffle further being disposed about a central aperture disposed in said interior wall portion.

14. The wet vacuum system according to claim 13, wherein said inverted J-shaped baffle is made of a material impervious to rust and corrosion.

15. A wet vacuum system for removing liquids from floors comprising:

a support base structure having a plurality of wheels for rolling contact with a floor;

a housing mounted on said base structure;

a vacuum head assembly disposed rearward of said housing and connected to said base structure by sweep arm;

a lever mechanism mounted rearward of said housing for raising and lowering said vacuum head assembly;

a reservoir mounted on said base structure within said housing for receiving liquids removed from a wet floor surface, said reservoir having a drain for draining the liquids from said reservoir;

vacuum means for producing a vacuum by drawing air from said reservoir, said vacuum means being mounted within said housing and including a vacuum box in fluid connection with said reservoir, said vacuum box defining an internal baffle for separating liquids from the air drawn from said reservoir and subsequent drainage of the fluids from said vacuum box; and a reinforcement mechanism disposed inside said reservoir for preventing buckling of said reservoir from vacuum pressure, wherein said reinforcement mechanism comprises:

a first threadedly adjustable rod with first and second planar ends for mating and frictionally attaching to a first and second interior wall portion of said reservoir, said first rod having a turnbuckle for adjusting the length of the rod;

a second threadedly adjustable rod with first and second planar ends for mating and frictionally attaching to a third and fourth interior wall portion of said reservoir, said second rod having a turnbuckle for adjusting the length of the rod; and a bracket coupling said first and second rods perpendicular to each other.

* * * * *